United States Patent [19]

Wynn

[11] 4,041,824

[45] Aug. 16, 1977

[54] LOCATION APPARATUS

[76] Inventor: Gordon Williams Wynn, 308, Northridge Way, Hemel Hempstead, Hertfordshire, England

[21] Appl. No.: 584,289

[22] Filed: June 6, 1975

Related U.S. Application Data

[63] Continuation of Ser. No. 174,423, Aug. 24, 1971, abandoned.

[51] Int. Cl.[2] ..... B27G 5/02; B27F 1/14

[52] U.S. Cl. ..... 83/763; 83/764; 83/761; 83/820

[58] Field of Search ..... 83/760, 761, 762, 763, 83/820, 765, 766, 767

[56] References Cited

U.S. PATENT DOCUMENTS

| | | | |
|---|---|---|---|
| 150,970 | 5/1874 | Munroe | 83/762 |
| 369,770 | 9/1887 | Brewster et al. | 83/763 |
| 1,013,010 | 12/1911 | Graham | 83/762 |
| 1,393,126 | 10/1921 | Hinds | 83/760 |
| 2,618,299 | 11/1952 | Hunt | 83/763 |

*Primary Examiner*—Donald R. Schran
*Attorney, Agent, or Firm*—Elliot A. Lackenbach

[57] ABSTRACT

Location apparatus for making saw cuts in workpieces has a saw guide and support means for a workpiece to set a side face of the workpiece at predetermined positions to the saw guide. In various forms of the apparatus, said positions are angularly adjustable in horizontal and/or vertical planes. Means are also described for setting the workpiece to a predetermined location transversely of the sawing plane defined by said saw guide.

29 Claims, 14 Drawing Figures

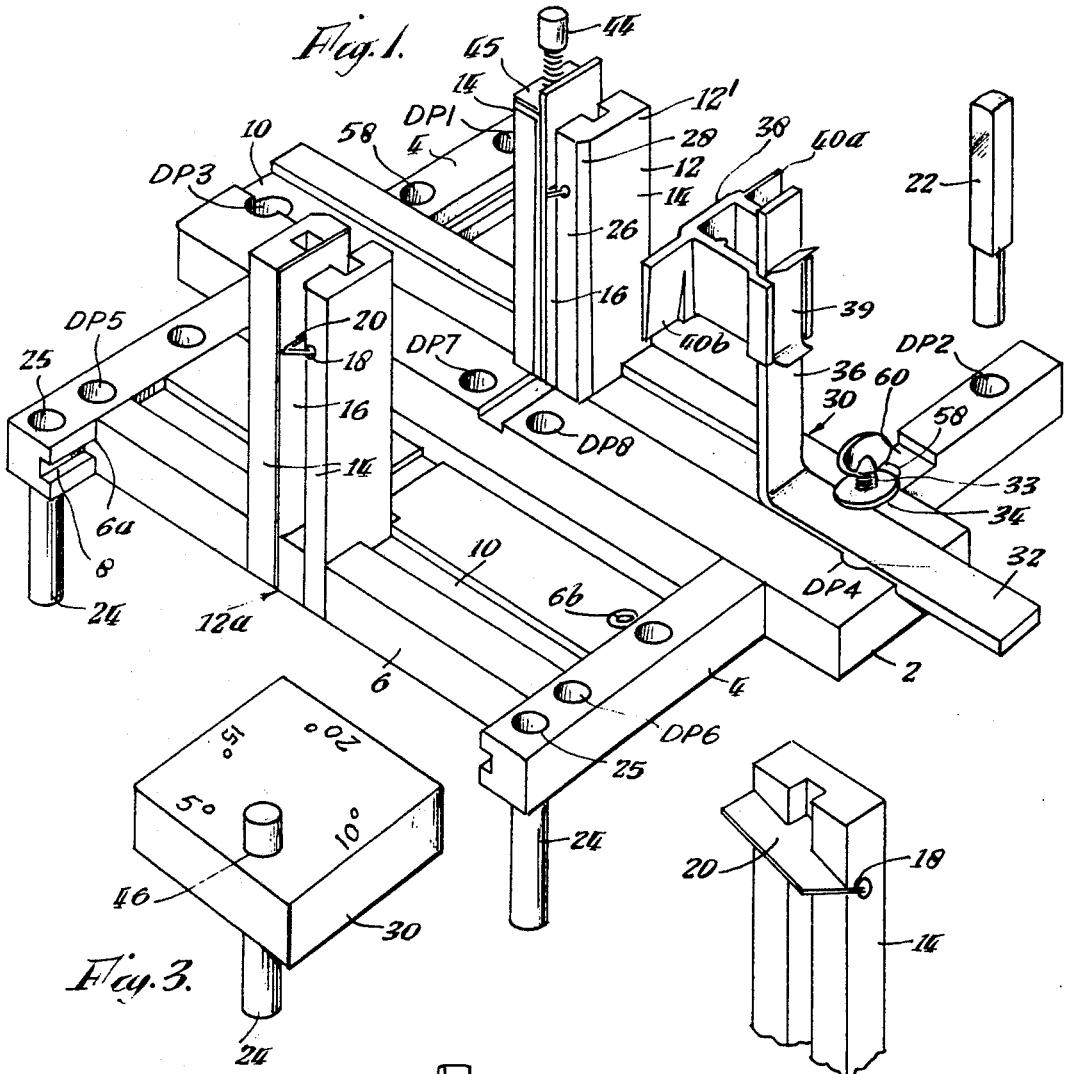
Fig. 3.
Fig. 2.
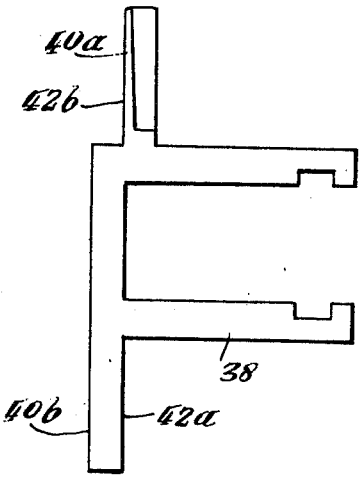
Fig. 5.

LOCATION APPARATUS

This is a continuation of application Ser. No. 174,423, filed Aug. 24, 1971, now abandoned.

This invention relates to apparatus for the location of workpieces in order to perform one or more operations, such as sawing, drilling, or glueing, upon the workpieces.

A known form of device for the location of a timber workpiece, to enable saw cuts to be made at specified angles to the axis of the workpiece, is the mitre box in which alternative guide slots for the blade of a saw are used to make angled cuts inclined at 45° to the right and left respectively. Another such device is known in which a single saw guide can be swivelled on the device to vary the angle of the cut.

One object of the present invention is to permit differently angled saw cuts to be made without the necessity of using different guide slots for each angle or of having to change the position of the saw to an adjusted orientation of a swivelling saw guide.

For this purpose, the invention can provide location apparatus for making a saw cut in a workpiece comprising a base on which the workpiece can be placed and having means for location of a face of the workpiece at a plurality of predetermined angles relative to a saw blade guide plane defined by at least one saw guide member mounted on the base. The or each guide member may have the form of a column projecting from the base.

Said location means may take the form of one or more engagement members against which the workpiece can bear and may be adjustable in position relative to the guide plane. Thus, such location engagement means may comprise one or more pin members having a plurality of receiving apertures in the base, the member or members being removably received in these apertures. Alternatively or additionally, an apertured member may be mountable in any of a number of alternative positions on a pin member on the base, or by a pin member integral with the apertured member, so that side surfaces of said apertured member thereby provide alternative location faces for the workpiece at different distances from said pin member.

Apparatus according to the invention preferably includes means to locate the workpiece in a predetermined position transversely of the saw guide plane, e.g. to place a saw-cut at a particular distance from an end face of the workpiece or an earlier saw-cut in the workpiece.

Such transverse location means may comprise a vertical member for gauging the workpiece position. For example, the member may carry alternative elements such that by bringing said end face or said earlier saw-cut into registration with different ones of the elements, at least one of which can seat in said earlier saw-cut, the position of a cut to be made in the workpiece, as determined by the sawing plane, is set relative to the first cut or end face. Such an arrangement can compensate for the width of the saw kerf in relation to the width of material to be removed to make a joint. Conveniently, a reversible selector bears the respective elements in the form of two blades one of which can be used for a tenon or like shouldered joint part at the end of the workpiece and the other for a recessed joint part intermediate the length of the workpiece.

The transverse location means may be adapted for use in making saw-cuts in elongate workpieces in planes parallel to or only slightly inclined from the longitudinal axis of such workpieces, a location face of the means then being engaged with a side face of the workpiece.

By way of examples only, embodiments of the invention will now be described in greater detail with reference to the accompanying drawings, in which:

FIG. 1 is a perspective view of a first location apparatus or jig according to the invention, FIG. 2 is a detail view of a part of a saw guide column of the jig of FIG. 1, FIG. 3 shows a spacer block for use with the jig of FIG. 1, FIGS. 4(*a*) to (*f*) are diagrammatic plan views showing the jig of FIG. 1 being used for different operations.

FIG. 5 is a detail plan view of the selector head of the jig of FIG. 1,

Figure 4A:
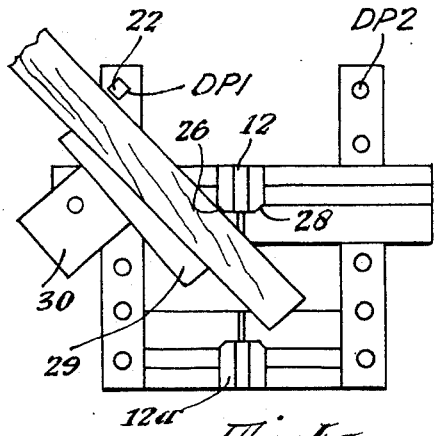

Referring more particularly to FIG. 1 of the drawings, the jig shown there comprises a base or support frame, e.g. of hardwood, that includes a main cross-member 2 to which two transverse connecting members 4 are secured, and a supplementary cross-member 6 having tongues 6*a* seating in grooves 8 in the connecting members 4 so that the member 6 can be slid towards and away from the member 2 and, if required, can be removed from the illustrated position between the forward ends of the connecting members and reinserted between the rear ends of these members to lie behind the main cross-member 2. A friction element 6*b* acts to keep the member 6 in any setting in which it has been placed. Although such adjustability of the member 6 increases the range of usefulness of the jig, it is not necessary for many operations and it is therefore possible for it to be fixed in position instead. Those faces of the members which are to be used to engage and locate a workpiece may be roughened or given an anti-slip coating or cover if required.

The two cross-members 2, 6 each have a longitudinal groove 10 and centrally of its length and at said groove, each member has a vertical guide column 12, 12*a* respectively which may be permanently or detachably secured in place. The columns act as co-planar guides for a saw blade and each comprises a pair of parallel limbs 14 one of which is faced with a wear-resistant plate 16, on which a side face of the saw blade can be located. Seated in a groove 18 that is obliquely inclined when viewed from the front, there is a strip 20, e.g. of nylon, that acts as a spring urging the saw blade against the location face formed by the plate 16. The choice of a suitable plastics material for the plate has the effect that movement of the saw blade in the guide hones the saw teeth to a certain extent.

At accurately spaced positions on the jig is a series of receiving holes DP 1 to DP 8 in which there can be inserted square-headed location pins 22 or dowel pins 24. These pins, in conjunction with the guide columns themselves when required, act as engagement members to locate the workpiece in the required sawing position relative to the saw guide plane defined by the columns. To act as a stop locating the jig against the edge of a work bench, further dowel pins can project downwards from two of the holes, or from other such holes such as are shown at 25 in FIG. 1, to bear against the edge of the bench.

By way of example, FIG. 4 illustrates a number of modes of operation of the jig of FIG. 1, the workpiece in each instance being held or wedged against a plurality of location points provided by one or more dowels at different ones of the positions DP 1 to DP 8, sometimes the guide column 12 on the main cross-member 2 being used to provide a further location point, for which purpose the limbs of the column have a planar front face 26 and side edges 28 chamfered at 45° to the front face.

In the arrangement shown in FIG. 4*a*, an elongate workpiece is wedged against a pin 22 located in hole DP 1 and against the guide column 12, it thus being held with its longitudinal axis at 45° to the saw guide plane for the cutting of a mitre joint face.

For clamping a workpiece, a single wedge 29 or a pair of wedges may be inserted in the space between the workpiece and a dowel pin, depending upon the width of the space to be filled. The wedges may be used in conjunction with other packing members, such as the spacer block 29*a* shown in FIG. 4*a* located on a dowel pin in the hole DP 3. The block 29*a* has other functions that will be referred to below.

Figure 4B:
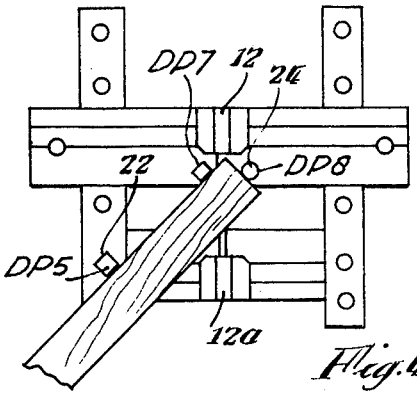

If a mitre with half lap joint is wanted, to allow the mitred face to be cut in the appropriate relation to the squared end face of the workpiece, pins in the holes DP 7 and 5 are used, as shown in FIG. 4*b* and a further pin in the hole DP 8 bears on the squared end face of the workpiece. In order to give better support to the workpiece in this second instance, however, where the workpiece does not bear on a guide column, it is possible to provide a shouldered pin (not shown) one end of which seats in a receiving hole, e.g. DP 7 in this instance, and the other, smaller diameter end of which seats in a bore in the wedge 29 close to its narrow end face. The arrangement is such that the narrow end face of the wedge forms a location for the workpiece and the bottom face of the wedge is itself adequately supported by the jig frame to prevent any tilting of the location face.

It will be appreciated that the opposite half of the mitre joint to that illustrated can be cut using the pin location holes in the opposite half of the jig since there is a symmetrical arrangement of location holes.

Figure 4C:
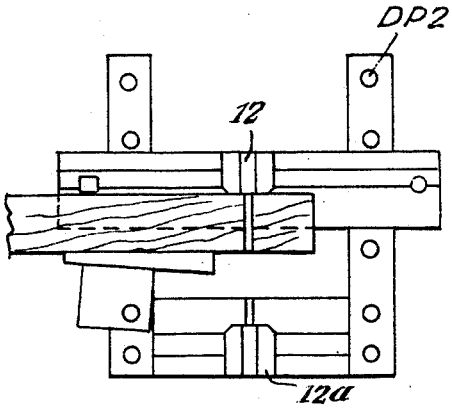

FIG. 4*c* shows an elongate workpiece being cut at 90° to its axis, the guide column 12 and a location pin 22 in the hole DP 3 forming a location plane for the workpiece, which is held in position by a spacer block 29*a* and wedge 29 as already described.

Figure 4D:
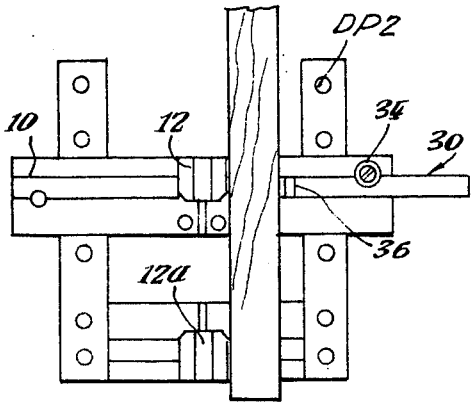

When cutting halved joints and tenons, in which the width of the material to be removed from a workpiece is dependent upon the width of the mating part of the joint, transverse location means are employed for determining the saw cut position along the length of the workpiece. Such means are shown in FIGS. 1 and 5 and comprise a right-angled gauge bar 31 slidably mounted in the groove 10 of the cross-member 2 by its lower limb 32, a locking thumbscrew 33 and washer 34 being retained by a tapped hole in the cross-member 2 and clamping the gauge bar when screwed down. Referring to FIG. 4*d* the initial step in setting the gauge bar involves sliding the gauge bar forwards until its upper limb 36 bears lightly on the member inserted between it and the guide column 12 and clamping the gauge bar in that position.

A selector head 38 can then be slid onto the limb 36 on which it is frictionally gripped by the action of a spring 39 e.g. of nylon. The head 38 is provided with opposed blades 40*a*, 40*b*, each of wedge form but tapering in opposite directions and having vertical faces 42*a*, 42*b* in a common plane which is spaced from the adjacent face of the vertical limb 36 by a distance equal to that between the location face formed by the plate 16 and the opposite side face 12' of the guide column 12. The alternative blades 40*a* and 40*b* of the selector head 38 provide for the formation of a jointing recess in a workpiece, either intermediate the length of the workpiece when the width of the recess will include two saw kerfs, or, in contrast to this closed form of recess, an open recess at the end of the workpiece, when the recess width will include only one saw kerf.

Figure 4E:
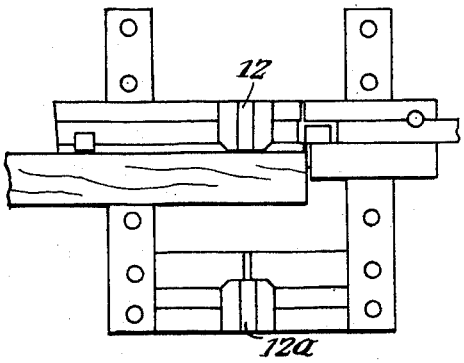
Figure 4F:
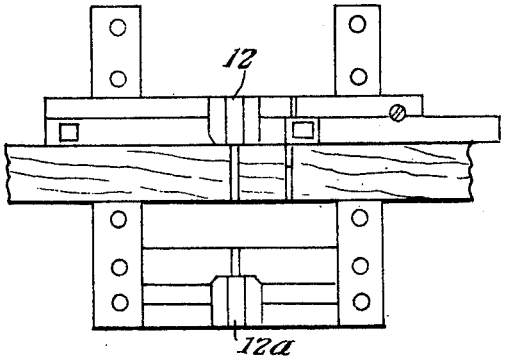

For an open recess or tongue, the selector head is slipped onto the clamped gauge bar with its blade 40*a* operative, as shown in FIG. 4*e*, and the workpiece is brought into abutment with the blade, it then being in position for a saw cut to be made at the saw guide plane to form the end face of the recess. For a closed recess, one of the end faces of the recess is first cut in the workpiece and then, with the selector head reversed so that its blade 40*b* is operative, as shown in FIG. 4*f*, the blade is slid into the first saw cut, and the workpiece will then be correctly positioned for the second end face to be sawn. In both instances, with the required cross-cut or cuts completed, the remaining waste material can be removed to complete the recess.

Instead of using a contacting selector head as described above, it is possible to locate a workpiece for similar saw-cutting operations by employing a sighting procedure using the gauge bar alone or with the selector head or other member secured to it and used as a non-contacting sighting element.

In order to control the depth of a saw cut in a workpiece, one or both guide columns can be provided with adjustable depth-stops. Such a device is shown in FIG. 1 in the form of a plastic-headed screw 44 extending vertically into a hole at the top of the column 12 and located at the required height by a nut 45 threaded onto it which rests on top of the column. The head of the screw is of a size that allows it to engage with the back or spine of a tenon saw as the saw cut proceeds, so limiting the cut depth to that set by the screw.

The spacer block 29*a* referred to above is intended to be used also to obtain an oblique setting for a workpiece relative to the saw guide plane. The block is shown square but can be of any polygonal form, and it has a hole 46 so located in it that the hole axis is at a different distance from each edge of the square or polygon. Thus by positioning the block by its hole on a dowel pin, for example at the location DP 6, the block can be rotated to provide four alternative locating faces for a workpiece each of which will set the transverse axis of the workpiece at a different angle to the saw guide plane. In the illustrated example the angles are 5°, 10°, and 20° when the block is on a pin at the location DP 3, and the workpiece also bears against the guide column 12. The wedge or wedges 29 can also be used to provide particular angle settings, either alone or in conjunction with the spacer block, and for this purpose there are preferably at least two wedges with angles of 6° and 8° respectively. Wedges with these particular angles can be employed in the apparatus to cut dovetail joints. In some instances the wedge will have one face parallel to the member 2 and perpendicular the plane of the frame formed by the members 2, 4, 6 and in other instances it will have one face parallel the member 2 and the plane of the frame formed by the members 2, 4, 6. In the first case, the workpiece will have its axis set obliquely to the member 2 but in a plane parallel to the plane of the frame, while in the other case the workpiece axis will be oblique to the plane of the frame but will lie in a plane parallel to the member 2.

It will be appreciated that the spacer block can be used on pins at different positions and in conjunction with two such wedges to locate the workpiece at any one of a range of angles, including the mitre angles required for regular polygonal frames, such as 60° (3-sided), 36° (5-sided), 30° (6-sided) or even 18° (10-sided).

Figure 6:
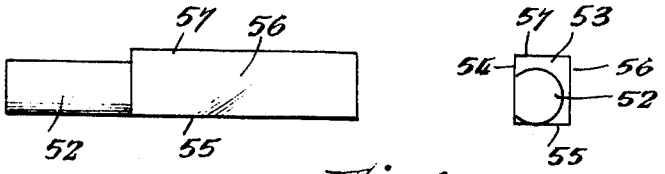
FIG. 6 shows side and plan views of a location pin for use with the jig of FIG. 1, FIGS. 7 and 8 are perspective views of modified forms of the jig of FIG. 1.

The location pins 22 have the form indicated in FIG. 6. The lower circular shank 52 is the same diameter as the dowel shank so that faces 54, 55, 56, 57 are at progressively greater distances from the shank axis, the face 55 being tangential to the circular shank. Preferably, the circular shank 52 is ground away or otherwise relieved so that it does not project beyond the face 54. These different settings may provide, for example, changes in the angle setting of a workpiece of $-\frac{1}{2}°$, 0°, $+\frac{1}{2}°$ and 1°. In this way, by selecting the face on which a workpiece is to bear, slight changes of setting can be obtained to compensate for tolerances in the alignment of the jig, for example, or to modify the setting obtainable by use of the spacer block and wedges, e.g. so as to obtain a $22\frac{1}{2}°$ mitre angle for a regular 8-sided frame. If desired, the block 30 may be given a square hole to receive a location pin 22.

The apparatus may also be used to make saw cuts in a workpiece parallel or at small angles to the longitudinal axis of the workpiece, in which case the supplementary cross-member 6 is preferably inserted in the rear ends of the connecting members 4 and the jig is reversed so that dowel pins in the additional holes 58 act as bench stops. The workpiece can be inserted in the opening between the two cross-members and clamping means applied to these members to hold the workpiece firmly in position. It is to be noted that the rear face 12' of the column 12 is flush with the rear face 2' of its cross-member 2 so that the workpiece will then bear directly on the column.

It is possible to use the gauge bar 31 as a vertical guide by placing its limb 32 in a further slot 60 where it can be locked in position by the thumbscrew 33 since the washer 34 overlaps that further slot 60 also. The vertical limb 36 of the gauge bar can then be used as a bearing location for the workpiece and, in conjunction with the rear face of the column 12, it will set the workpiece square for a longitudinal saw cut to be made. Alternatively, the slot 10 in the cross-member 6 can be used for this purpose, the member 6 then preferably being fixed in position and the slot 10 extending across one connecting member 4. A blade of the selector head on the bar 30 would then project into the space in front of the member 6.

Figure 7:
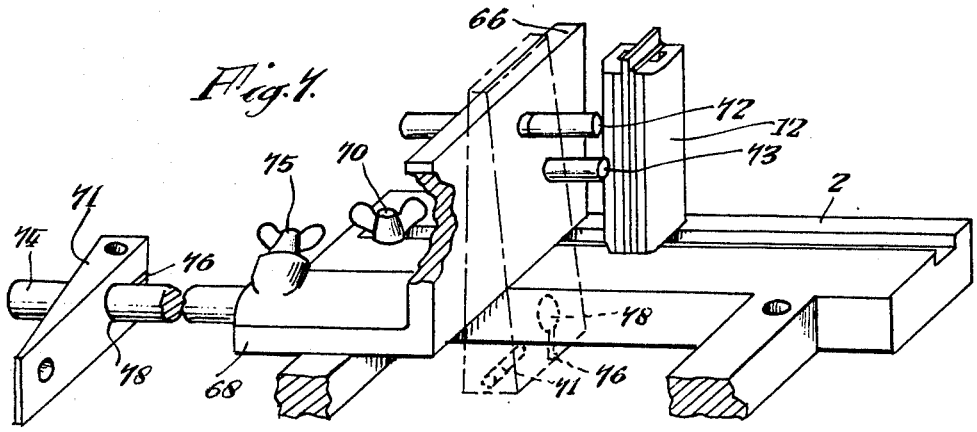

Longitudinal or near-longitudinal saw cuts can also be made using an alternative form of transverse location attachment such as is illustrated in FIG. 7 being used with a modified form of jig but which can with suitable modification of the jig in FIG. 1, be used there also.

Referring to FIG. 7, the attachment comprises a right-angled component having vertical and horizontal plates 66, 68 respectively. The attachment is slidable along the groove 10 in the cross-member 2 (or unillustrated cross-member 4) of the jig to which it can be locked by a locking nut 70 on a bolt extending through an elongate slit in the plate 68 parallel to the groove 10. The workpiece is positioned in the opening to the front of the cross-member 2 to extend below the support frame with a longitudinal side face resting against the plate 66, the setting of the attachment determining the position of the workpiece relative to the saw guide plane. Advantageously the workpiece is held vertical by means of a clamp integral with the jig (e.g. the supplementary cross-member 6) or by a bench vice or, alternatively, where no such means is available, the jig can be so positioned to lock the workpiece between the jig and a work table.

In the production of dovetail joints, for example, where oblique cuts are required in the end face of a workpiece, the vertical attachment can be used in conjunction with one or more wedges 71 as shown in FIG. 7 to provide an appropriately inclined abutment face for the workpiece relative to the saw guide plane. The wedges and the vertical plate 66 may have holes for dowel pins to locate a wedge on the plate 66. In addition, these pins may also aid in the positioning of the workpiece for sawing, one pin 72 acting as a height stop member and another pin 73 determining the lateral position of the workpiece on the plate 66.

The attachment is provided with an elongate rod 74 of circular cross-section extending from and slidably mounted in the plate 68 and lockable thereto by a clamping nut 75. One or more wedges 71 may be slidably mounted on the rod 74 at different positions along the rod and at different angular positions relative to each other, the wedges each having a slot 76 to form jaws that can be drawn together to grip the rod where it passes through bore 78 of the wedge. Wedges so mounted on the rod can be used as stop-members for a workpiece positioned horizontally on the jig, a chosen wedge being brought into position by rotating the rod 74 until that wedge extends across the longitudinal projection of the workpiece and thus provides an end-stop for the workpiece. A further location for the workpiece is afforded by the side face of the horizontal plate 68. It is to be appreciated that the different features described for the wedges 71 can be provided together in common wedge members.

Figure 8:
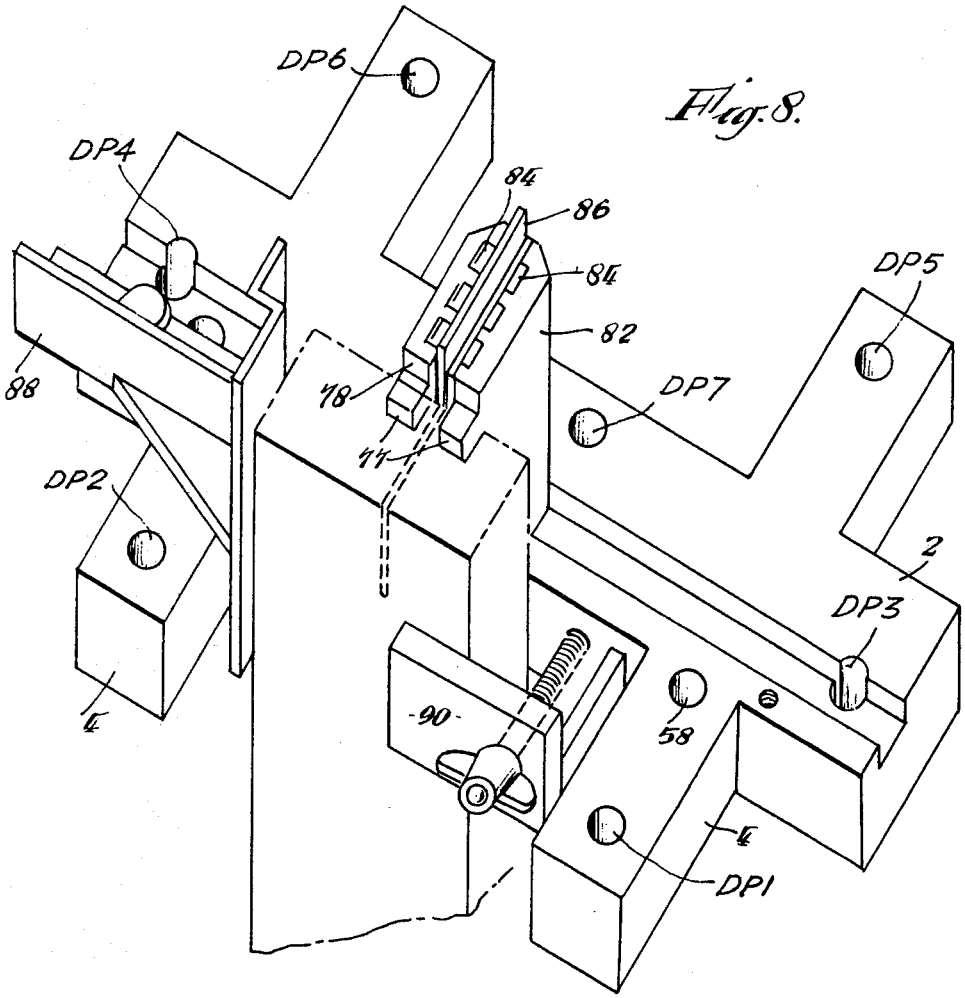

FIG. 8 illustrates a jig similar in many respects to the jig of FIG. 1 and corresponding parts are given the same reference numbers. It will be noted that in this construction there is only a single cross-member 2 carrying a single guide column 82 which now has a series of mounting springs 84 for the guide plates 86. Vertical stops 77 are provided on planar face 78 of the column 82, which face is protuberant of the cross-member 2, to form a vertical guide face for location of the workpiece. A second vertical guide face perpendicular to the face 78 is provided by a detachable abutment member 88 that is adjustably positionable along the cross-member 2. A screw clamp 90 holds the workpiece firmly in position in the opening provided for it to the front of the cross-member 2.

Figure 9:
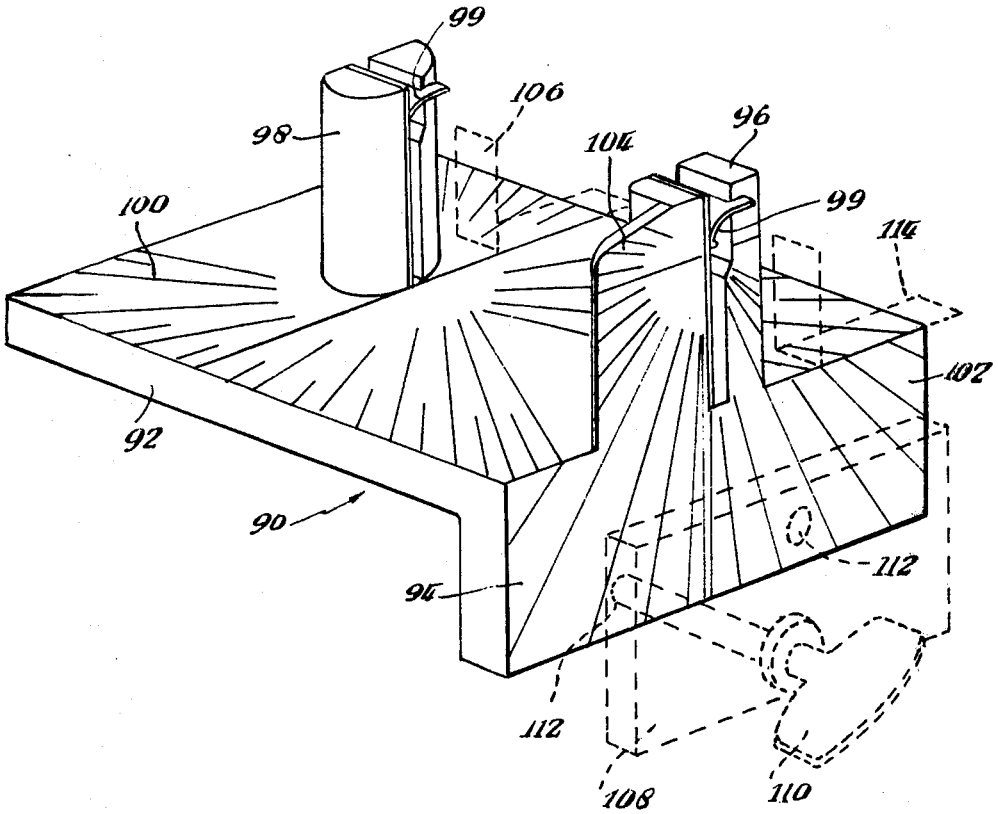
FIG. 9 shows a further form of location apparatus according to the invention.

FIG. 9 shows a further embodiment of the invention comprising a base in the form of an angle plate 90 which can be placed on the edge of a workbench (not shown) with a horizontal top plate 92 resting on the top surface of the bench and a vertical front plate 94 depending therefrom to bear against a front side face of the bench. Two saw guide columns 96, 98 are disposed one behind the other on the top face to define a saw guide plane analogously to the examples already described, the front column 96 being at the junction of the top and front faces of the base. Resilient strips 99 analogous to the strips 20 of earlier examples such as FIG. 1 urge a saw blade against wear-resistant plates in the guide columns and the present illustration shows how the resilient strips can be set in slots that run horizontally from front to rear.

On the top face of the plate 92 there is a series of lines 100 marked, etched, cut or otherwise formed, to radiate from the rear column 98, these defining guides for a workpiece (not shown) resting on the top face to locate a side face of the workpiece at predetermined angular positions relative to the saw guide plane. The lines are so placed that the side face of the workpiece aligned with them also bears against the rear column 98 for which purpose the forward face of the column has a curved profile. On the front face of the plate 94, a similar series of lines 102 are provided at different angular orientations to the vertical and the front column 96 has an extended side face 104 to carry some of this second series of lines.

Transverse location means analogous to those shown in the earlier figures may also be provided, on the top face at least, as indicated at 106. The apparatus may be arranged to allow the workpiece to be clamped against the face on which it bears, as indicated by the clamping plate 108 carried by a thumbscrew 110 engageable in alternative threaded bores 112, or it may be sufficient simply for the workpiece to be held in place by hand as it is sawn. FIG. 9 also shows a location means 114 disposed adjacent the front column for use in conjunction with an attachment such as the selector head 38 to locate a side face of a workpiece that bears against the front face of the plate 94 to make longitudinal saw cuts in the workpiece, analogously to the arrangement described above for this purpose using the gauge bar 30.

What I claim and desire to secure by Letters Patent is:

1. Location apparatus for use in making a saw cut in a workpiece and comprising, in combination, a base on which the workpiece is placed, at least one saw guide member mounted on said base to define a saw blade guide plane at a predetermined setting to the plane of said base, said saw guide member comprising a pair of elements extending vertically from the base at a spacing from each other to provide an upwardly open gap for the insertion and removal of a saw blade, a side face of one of said elements forming an abutment face for the saw blade and said other element comprising means for resiliently urging the saw blade against said face while yet enabling insertion and removal of the saw blade through said upwardly open gap, a series of fixed locations being provided at spaced positions on said base, a plurality of location elements being selectively engageable with respective ones of said locations for defining a series of different and predetermined angular settings for the workpiece relative the saw guide plane permitting correspondingly oriented saw cuts to be made in said workpiece, guide means on said base extending from adjacent said at least one saw guide member transversely to said guide plane, and transverse position location means displaceably guided by said guide means for providing a location for the workpiece in said direction transverse the saw guide plane.

2. Location apparatus defined in claim 1 wherein a front face of said one element of the saw guide member provides an angular setting location for the workpiece and extends laterally outwardly of said abutment face a substantial distance generally perpendicular said abutment face so that wear of the walls of said abutment face will not substantially affect the alignment of said front face relative said fixed locations.

3. Location apparatus defined in claim 1 wherein said fixed locations comprise a plurality of receiving apertures in said base and said location element comprises a pin member that can be removably inserted in said apertures selectively.

4. Location apparatus defined in claim 3 wherein said pin member comprises a plurality of side faces that are selectively engageable with the workpiece by rotation of the pin member relative said apertures in order to locate said workpiece at different distances from the axis of rotation.

5. Location apparatus defined in claim 2 wherein a stop member is adjustably mounted on said at least one saw guide member, said stop member being adapted to provide a predetermined abutment stop for the spline of a back saw so as to limit the depth of cut of the saw.

6. Location apparatus for use in making a saw cut in a workpiece and comprising, in combination, a base on which the workpiece is placed, at least one saw guide member mounted on said base to define a saw blade guide plane at a predetermined setting to the plane of said base, said saw guide member comprising a pair of elements extending vertically from the base at a spacing from each other to provide an upwardly open gap for the insertion and removal of a saw blade, a side face of one of said elements forming an abutment face for such saw blade and said other element comprising means for resiliently urging such saw blade against said face, a series of apertures being provided at spaced positions on said base, a plurality of location devices being selectively engageable with respective ones of said apertures to define a plurality of spaced location points for the workpiece, whereby to obtain a series of different and predetermined angular settings for the workpiece relative the saw guide plane permitting correspondingly oriented saw cuts to be made in the workpiece by using said at least one saw guide member to guide such saw, at least one of said location devices comprising a plurality of side faces that are selectively engageable with the workpiece by rotation of the device relative its engaged aperture in order to locate the workpiece at different distances from the axis of rotation.

7. Location apparatus for use in making a saw cut in a workpiece and comprising, in combination, a base on which the workpiece is placed, two saw guide members mounted at spaced positions on said base to define a saw blade guide plane at a predetermined setting to the plane of said base, each said saw guide member comprising a pair of elements extending vertically from the base at a spacing from each other to provide an upwardly open gap for the insertion and removal of the saw blade, a side face of one of said elements forming an abutment face for the saw blade and the other of said elements comprising means for resiliently urging the saw blade against said face, a series of fixed locations being provided at spaced positions on said base, a plurality of location elements being selectively engageable with respective ones of said locations for defining a series of different and predetermined angular settings for the workpiece relative the saw guide plane permitting correspondingly oriented saw cuts to be made in said workpiece by using said saw guide members to guide the saw, respective guide means on the base adjacent each saw guide member and extending transversely to the saw guide plane, and transverse workpiece location device being adjustable locatable by said guide means for locating the workpiece at predetermined positions transversely of the saw guide plane.

8. Location apparatus for use in making a saw cut in a workpiece and comprising, in combination, a base on which the workpiece is placed, at least one saw guide device projecting upwardly from said base, said device comprising a rigid member defining a saw guide plane at a predetermined setting to the plane of the base and a resilient member also secured to the base for urging a saw blade into the guide plane defined by said rigid member, an upwardly open gap being formed between said members for facilitating the insertion of a saw blade from above, a plurality of fixed locations at spaced positions on the base, a plurality of location elements being selectively engageable with respective ones of said locations for providing location abutments for the workpiece, said locations thereby being able to define a series of different and predetermined angular settings for a side face of the workpiece relative the saw guide plane for permitting a correspondingly oriented saw cut to be made in the workpiece by using said at least one saw guide device to guide a saw, a first two of said locations being located immediately adjacent said at least one saw guide device and on opposite sides of the saw guide plane, a third location distant from the saw guide plane being on the same side of the saw guide plane as a first of said two locations and defining with said first of said two locations a side face setting at 45° to the saw guide plane and the other of said first two locations then defining an end stop for an end face of a workpiece at said 45° setting whereby, with said end face perpendicular the side face engaging the location elements at said 45° setting a corner edge of the workpiece between said side and end faces is located substantially in the saw guide plane, said locations further defining a workpiece side face setting perpendicular to the saw guide plane.

9. Location apparatus defined in claim 6 wherein said base carries a device displaceable towards and away from said saw guide plane and forming transverse location means to locate the workpiece in a predetermined position transversely of the saw guide plane.

10. Location apparatus defined in claim 7 wherein said transverse location means is adjustable on the base to a position in which it overhangs the base for locating a side face of an elongate workpiece parallel or at a small angle the saw guide plane with the workpiece depending to below the base and at a regulatable distance from the saw guide plane.

11. Location apparatus defined in claim 9 wherein said transverse location means comprises an angle-form device displaceable on the base towards and away from the saw guide plane and providing an abutment face for the workpiece.

12. Location apparatus defined in claim 6 wherein two of said apertures are provided adjacent said at least one saw guide member on opposite sides of the saw guide plane whereby one of said two apertures is employed in conjunction with a further one of said plurality of apertures to determine said predetermined angular setting for the workpiece and the other of said two apertures provides a setting for a perpendicular end face of the workpiece such that an edge of said end face is located substantially in the saw guide plane.

13. Location apparatus for making a saw cut in a workpiece and comprising, in combination, a base on which the workpiece is placed, at least one saw guide member mounted on said base to define a saw blade guide plane at a predetermined setting to the plane of said base, a plurality of fixed locations being provided at spaced positions on said base for location of a face of said workpiece at a plurality of predetermined locations relative said saw blade guide plane in order to make a correspondingly oriented saw cut in the workpiece by using said at least one saw guide member to guide the saw, at least one location member selectively engageable with respective ones of said locations for providing alternative abutment locations for said face of the workpiece, said at least one location member being mounted on the base to be rotatable about an axis projecting from the base, a plurality of side faces of said at least one location member being selectively engageable with the workpiece by said rotation of the location member in order to locate said workpiece at different distances from said axis of rotation.

14. Location apparatus for use in making a saw cut in a workpiece and comprising, in combination, at least one saw guide member defining a saw guide plane for said cut, workpiece location means comprising engagement means for abutting contact with at least one face of the workpiece to locate said workpiece face at a predetermined angular orientation to said at least one saw guide member and its guide plane in order to make a correspondingly oriented saw cut in the workpiece with the saw guided by said saw guide member, transverse position location means for the workpiece comprising a location device having a first elongated element extending transversely the saw guide plane and a second elongated element extending parallel the saw guide plane, said second elongated element projecting upwardly above said first elongated element and directed transversely said engagement means, the location device being disposed in a region permitting a workpiece located by said engagement means to extend in said transverse direction from the saw guide plane to beyond said second elongated element, guide means on the workpiece location means engaging said first elongated element in a manner permitting movement of said location device towards and away from the saw guide plane for adjustment of the position of said second elongated element of the location device in a direction transverse the saw guide plane, and means releasably securing said location device with the workpiece location means whereby said second elongated element is fixed at a selected spacing from the saw guide plane to be employed in determining the workpiece position in said transverse direction by alignment of a chosen point intermediate the length of the workpiece with the device.

15. Location apparatus defined in claim 14 wherein said first elongated element comprises a substantially flat lower surface and a pair of parallel side edges and said guide means comprises a flat bottomed uniformly elongated groove for limiting movement of said location device to straight line movement perpendicular said saw guide plane.

16. Location apparatus defined in claim 15 wherein said workpiece location means comprises a base supporting said saw guide member and having a generally planar workpiece supporting surface extending generally perpendicular said saw guide plane adjacent the saw path, said engagement means being selectively carried by said base extending generally perpendicular said support surface, said groove extending along said base defining a recess into said support surface.

17. Location apparatus defined in claim 14 further comprising a selector head adjustably mounted on said location device, two blades on said head being mutually offset in said transverse location direction by the width of a saw cut, said blades being alternatively employed to locate the workpiece in one of two positions transversely of the saw guide plane with said device fixed relative the saw guide plane.

18. Location apparatus defined in claim 17 for use in making a joint between two elongate, mutually transverse members, wherein gauging means are provided comprising a surface parallel and facing an upright surface of said location device to determine the position of one of said two blades for the making of a transverse saw cut in one of such workpiece members for the formation of a recess therein by employing the other of such workpiece members to set the distance of said location device from the gauging means.

19. Location apparatus defined in claim 16 wherein said location device is adjustable on the base to a position in which it locates a side face of an elongate workpiece parallel to the saw guide plane and at a regulatable distance from the saw guide plane.

20. Location apparatus for use in making a saw cut in a workpiece and comprising, in combination, at least one saw guide member defining a saw guide plane for said cut, workpiece location means comprising engagement means for abutting contact with at least one face of the workpiece to locate said workpiece face at a predetermined angular orientation to said at least one saw guide member and its guide plane in order to make a correspondingly orientated saw cut in the workpiece with the saw guided by said saw guide member, transverse position location means for the workpiece comprising a location device having a first elongated element extending transversely the saw guide plane and a second elongated element extending parallel the saw guide plane, guide means on the workpiece location means engaging said first elongated element in a manner permitting movement of said location device towards and away from the saw guide plane for adjustment of the position of said second elongated element of the location device in a direction transverse the saw guide plane, and means releasably securing said location device with the workpiece location means at a selected spacing from the saw guide plane, a selector member being slidably mounted on the location device to be adjustably positioned along the extent of said second elongated element of said location device, said selector member having two blades mutually offset in said transverse direction and being reversible on said location device to bring either of said blades selectively to an operative position, said blades being employed alternatively when the location device is fixed relative the saw guide plane in order to locate the workpiece in either of two positions in said transverse direction differing by the width of a saw cut transversely the saw guide plane.

21. Location apparatus for use in making a saw cut in a workpiece spaced apart from a previously existing saw cut in such workpiece to define a gap between said saw cuts equal to the thickness of a second workpiece for mutual engagement therewith comprising, in combination, a support structure, at least one saw guide member projecting from said support structure and defining a saw guide plane extending transversely thereto, said saw guide member having a gauging face defining an abutment surface parallel and spaced apart from said saw guide plane by a predetermined distance, transverse position location means mounted on said support structure to control the position of the workpiece in a direction transverse the saw guide plane, said transverse position location means comprising a device having a first elongated element extending parallel the saw guide plane and means for enabling selective movement thereof generally perpendicular said saw guide plane and workpiece setting means selectively mountable with said transverse position location means for enabling engagement of a workpiece between said gauging face and said transverse position location means to locate said workpiece setting means relative said saw guide plane a distance such that engagement of said workpiece setting means with such previously existing cut on a workpiece enables production of a cut by a saw guided by said saw guide plane spaced apart from such previously existing cut by the width of the workpiece engaged between said gauging face and said transverse position location means.

22. Location apparatus for use in making a saw cut in a workpiece and comprising, in combination, at least one saw guide member defining a guide plane for said cut, the or each saw guide member comprising a pair of elements spaced from each other to define an upwardly open gap for insertion of the saw blade, one of said elements having a surface facing said gap defining the saw guide plane and the other of said elements comprising resilient means adapted to urge the saw blade into contact with said surface, said resilient means comprising an oblique upper surface extending generally upwardly and outwardly of said saw guide surface of said one element so that downward insertion of a saw into said gap urges said resilient means away from said saw guide surface of said one element.

23. Location apparatus defined in claim 22 wherein said saw guide member further comprises engagement means for abutting contact with at least one face of the workpiece for location of the workpiece relative the guide plane, said engagement means being rigidly fixed with respect to the guide member surface so that said surface and, therefore, said saw guide plane is accurately, consistently and repeatedly oriented relative thereto.

24. Location apparatus defined in claim 22 wherein the other of said elements comprises a rigid support, a sheet-like element of resilient material being carried by said support to urge the saw blade into contact with said element surface.

25. Location apparatus defined in claim 22 wherein said saw guide member is in the form of a column with said pair of elements each being of vertically elongated form, and said resilient means oblique upper surface consists of an element of resilient material disposed in an upper region on the saw guide member.

26. Location apparatus defined in claim 22 further comprising a stop member projecting above said at least one saw guide member adjacent the open top of the gap permitting free movement of a back saw blade vertically into and out of the gap while limiting the penetration of the saw blade downwardly into said gap by engagement with the spine of such back saw blade, mounting means on said saw guide member removeably receiving the stop member, an element of said stop member being adjustably securable on the stop member before the member is received by said mounting means, the adjustment of said element determining the limit of said penetration of such back saw blade.

27. Location apparatus defined in claim 26 wherein said stop member comprises a threaded shank inserted in an aperture extending parallel the saw guide plane and extending above the saw guide member to be engageable with the back or spine of the saw, a nut element engaging the shank being adjustable therealong by rotation to determine the extension of the shank above the saw guide member whereby to vary the position of said stop member.

28. Location apparatus for use in making a saw cut in a workpiece and comprising, in combination, a base on which the workpiece is placed, at least one saw guide member mounted on said base to define a saw blade guide plane at a predetermined setting to the plane of said base, means on said base for location of a face of the workpiece at a predetermined location to said saw guide plane, a device on the base displaceable towards and away from said saw guide plane forming location means for the workpiece in a direction transverse to said guide plane, a selector head adjustably mounted on said device, two blades on said head being mutually offset in said transverse direction by substantially the width of a saw cut, the arrangement being such that with said device in a given setting relative the guide plane said blades are alternatively employed to locate the workpiece in one of two positions transversely the saw guide plane.

29. Location apparatus according to claim 28 wherein the selector head is slidably mounted to be adjustable perpendicularly the plane of the base.

* * * * *